US009852594B2

(12) United States Patent
Kim et al.

(10) Patent No.: US 9,852,594 B2
(45) Date of Patent: Dec. 26, 2017

(54) ELECTRONIC APPARATUS AND METHOD FOR DETERMINING STATES OF DOOR THEREOF

(71) Applicant: Samsung Electronics Co., Ltd., Suwon-si (KR)

(72) Inventors: Dong-wook Kim, Suwon-si (KR); Hyun-kyu Yun, Seoul (KR); Kyung-ik Cho, Yongin-si (KR); Jae-myung Hur, Seongnam-si (KR)

(73) Assignee: SAMSUNG ELECTRONICS CO., LTD., Suwon-si (KR)

( * ) Notice: Subject to any disclaimer, the term of this patent is extended or adjusted under 35 U.S.C. 154(b) by 0 days.

(21) Appl. No.: 15/370,513

(22) Filed: Dec. 6, 2016

(65) Prior Publication Data

US 2017/0162012 A1 Jun. 8, 2017

(30) Foreign Application Priority Data

Dec. 7, 2015 (KR) ..... 10-2015-0172990

(51) Int. Cl.
*G08B 13/08* (2006.01)
*E06B 7/28* (2006.01)

(52) U.S. Cl.
CPC ..... *G08B 13/08* (2013.01); *E06B 7/28* (2013.01)

(58) Field of Classification Search
CPC ..... H04W 4/00; G06F 1/00
See application file for complete search history.

(56) References Cited

U.S. PATENT DOCUMENTS

| | | | | |
|---|---|---|---|---|
| 2008/0106397 | A1* | 5/2008 | Van Esch | G01M 99/008 340/501 |
| 2013/0016211 | A1 | 1/2013 | Yeh | |
| 2013/0335222 | A1* | 12/2013 | Comerford | G08B 13/06 340/542 |
| 2014/0007684 | A1* | 1/2014 | Lin | G01P 15/008 73/514.09 |

FOREIGN PATENT DOCUMENTS

| | | |
|---|---|---|
| JP | 2006-241972 | 9/2006 |
| JP | 2006-323755 | 11/2006 |
| JP | 3173008 | 12/2011 |
| KR | 10-2007-0045073 | 5/2007 |
| KR | 10-2009-0029149 | 3/2009 |
| KR | 10-1392632 | 5/2014 |

* cited by examiner

*Primary Examiner* — Shirley Lu
(74) *Attorney, Agent, or Firm* — Staas & Halsey LLP

(57) ABSTRACT

An electronic apparatus attachable to a door and a method of determining door states. The electronic apparatus includes a sensor configured to measure an acceleration and an angular speed of the electronic apparatus, a processor configured to determine a state of the door by using the measured acceleration and angular speed, and a communicator configured to transmit the determined state of the door to an external apparatus.

19 Claims, 8 Drawing Sheets

ELECTRONIC APPARATUS AND METHOD FOR DETERMINING STATES OF DOOR THEREOF

CROSS-REFERENCE TO RELATED APPLICATIONS

This application claims priority from Korean Patent Application No. 10-2015-0172990, filed on Dec. 7, 2015, in the Korean Intellectual Property Office, the disclosure of which is incorporated herein by reference in its entirety.

BACKGROUND

1. Field

Apparatuses and methods consistent with the embodiments relate to an electronic apparatus and a method of determining states of a door thereof, and more particularly, to an electronic apparatus capable of determining states of a door, to which the electronic apparatus is attached, by sensing an acceleration and an angular speed, and a method of determining the states of the door thereof.

2. Description of the Related Art

The recent development of electronic technology has increased demands for technology that determines states of a thing and transmits the determined states to a user or a network such as a cloud server.

Existing door sensors determine states of a door by using a magnet, infrared (IR), or laser. Therefore, the existing door sensors have problems of limited sensing ranges and use scenarios.

The existing door sensors may frequently sense merely opening and closing of the door. Also, even when a door sensor is installed, the door sensor may be physically fixed to a door by using screws or the like.

There exist attempts to increase a use scenario by attaching a camera or the like, but there are problems of increasing electric power consumption and dropping a door sensor due to shocks occurring when opening and closing a door due to weight of the door sensor.

SUMMARY

Additional aspects and/or advantages will be set forth in part in the description which follows and, in part, will be apparent from the description, or may be learned by practice of the embodiments.

Exemplary embodiments overcome the above disadvantages and other disadvantages not described above. Also, the embodiments are not required to overcome the disadvantages described above, and an exemplary embodiment of the may not overcome any of the problems described above.

The embodiments provide an electronic apparatus capable of solving an inconvenience of an existing door sensor and determining states of a door based on sensed acceleration and angular speed, and a method of determining states of a door thereof.

According to an aspect, an electronic apparatus attached onto a door, includes a sensor configured to measure an acceleration and an angular speed of the electronic apparatus, a processor configured to sense an arrangement or arrangement form between the door and a doorframe to which the door is fixed, by using the measured acceleration and angular speed and determine whether the door is opened or closed, according to the sensed arrangement or arrangement form, and a communicator configured to transmit the determined state of the door to an external apparatus.

According to another aspect, a method of determining a door state of an electronic apparatus attachable onto a door, includes measuring an acceleration and an angular speed of the electronic apparatus, sensing an arrangement form between a doorframe to which the door is fixed and the door, by using the measured acceleration and angular speed, determining whether the door is opened or closed, according to the sensed arrangement form, and transmitting the determined state of the door to an external apparatus.

According to an aspect, a non-transitory computer readable recording medium storing a method of determining a door state of an electronic apparatus attachable onto a door, the method including measuring an acceleration and an angular speed of the electronic apparatus, sensing an arrangement between a doorframe to which the door is fixed and the door, by using the acceleration and angular speed, determining a door state as to whether the door one of is opened and closed, according to the sensed arrangement and transmitting the state of the door to an external apparatus.

According to an aspect, a method of determining a state of a door relative to a door frame, the method including sensing an acceleration and an angular speed of the door, determining the state as open when change in the acceleration and change in the angular speed is sensed, determining the state as closed when change in the acceleration is sensed and no change in angular speed is sensed and transmitting the state of the door to an external apparatus.

According to various exemplary embodiments, various types of door operations may be sensed by using sensed acceleration and angular speed. Also, a door may be simply installed, and an operation of the door may be sensed with a small amount of electric power.

Additional and/or other aspects and advantages will be set forth in part in the description which follows and, in part, will be obvious from the description, or may be learned by practice thereof.

BRIEF DESCRIPTION OF THE DRAWINGS

The above and/or other aspects will be more apparent by describing certain exemplary embodiments with reference to the accompanying drawings, in which.

DETAILED DESCRIPTION

Figure 1:
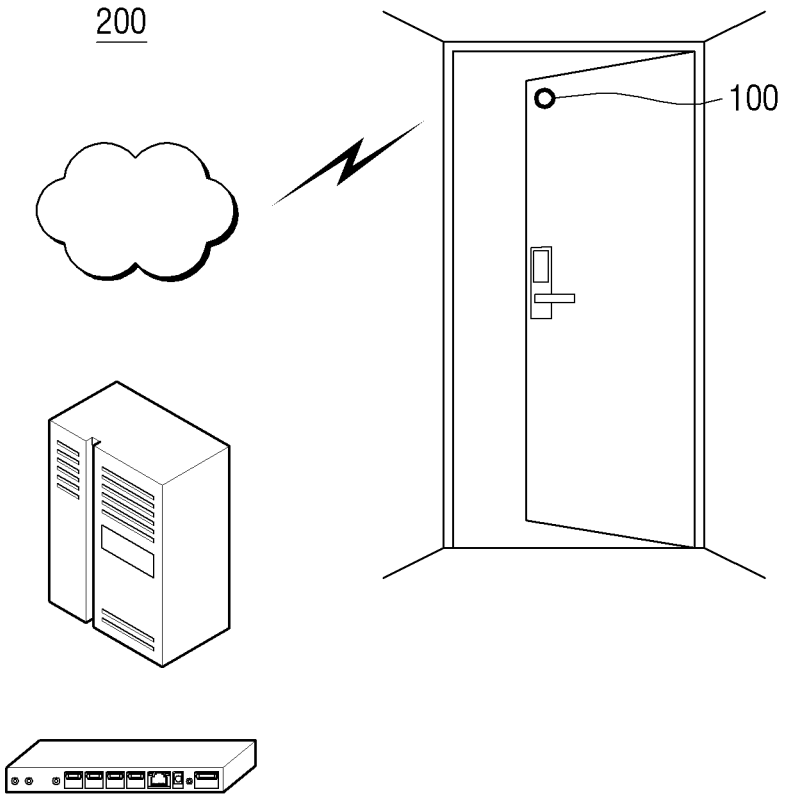
FIG. 1 is a concept view illustrating a concept of an electronic apparatus according to an exemplary embodiment.

Reference will now be made in detail to the embodiments, examples of which are illustrated in the accompanying drawings, wherein like reference numerals refer to the like elements throughout. The embodiments are described below by referring to the figures.

Certain exemplary embodiments will now be described in greater detail with reference to the accompanying drawings.

In the following description, the same drawing reference numerals are used for the same elements even in different drawings. The matters defined in the description, such as detailed construction and elements, are provided to assist in a comprehensive understanding. Thus, it is apparent that the exemplary embodiments may be carried out without those specifically defined matters. Also, well-known functions or constructions are not described in detail since they would obscure the embodiments with unnecessary detail. Also, terminology that will be described hereinafter is defined in consideration of functions in the embodiments and may be changed according to intentions, customs, or the like of users or operators. Therefore, the definition of the terminology may be given based on overall contents of the present specification.

Also, the terms "first", "second", etc. may be used to describe diverse components, but the components are not limited by the terms. The terms are merely used to distinguish one component from the others. For example, a first element could be termed a second element, and, similarly, a second element could be termed a first element, without departing from the scope of example embodiments. As used herein, the term "and/or," includes any and all combinations of one or more of the associated listed items.

The terminology used herein is for the purpose of describing particular embodiments merely and is not intended to be limiting of example embodiments. As used herein, the singular forms are intended to include the plural forms as well, unless the context clearly indicates otherwise. It will be further understood that the terms "comprises" and/or "includes" when used in this specification, specify the presence of stated features, integers, steps, operations, elements, and/or components, but do not preclude the presence or addition of one or more other features, integers, steps, operations, elements, components, and/or groups thereof.

FIG. 1 is a view illustrating an electronic apparatus 100 according to an exemplary embodiment. Referring to FIG. 1, the electronic apparatus 100 may operate with being attached onto a door. Also, the electronic apparatus 100 may determine states of the door by using acceleration and angular speed sensed in response to motions of the door. The electronic apparatus 100 may also transmit the sensed states of the door to an external apparatus 200.

For example, the external apparatus 200 may be realized as a cloud server, a management server, a home network hub, a wearable device, a mobile device, or the like. The electronic apparatus 100 and the external apparatus 200 may be connected to each other through a network to form an Internet of Things (IoT) environment. In detail, the electronic apparatus 100 and the external apparatus 200 may communicate with each other according to various methods such as Zigbee, Z-Wave, WFi, WiFi Direct, Bluetooth, and the like.

The electronic apparatus 100 is illustrated as being attached onto a pivotable hinged door in the exemplary embodiment of FIG. 1, but the types of door onto which the electronic apparatus 100 is attached so as to determine states are not limited thereto. For example, the electronic apparatus 100 may be attached onto various types of doors such as a revolving door, a sliding door, an automatic door, a window, a drawer, and the like.

The electronic apparatus 100 according to the exemplary embodiment may be made small, and thus is simply installed and consumes a small amount of electric power. For example, the electronic apparatus 100 may embody an acceleration sensor and a gyro sensor in one chip. Also, the electronic apparatus 100 may determine states of the door by using a Micro Controller Unit (MCU) of a communicator 120 without additionally including a processor 130.

Figure 2:
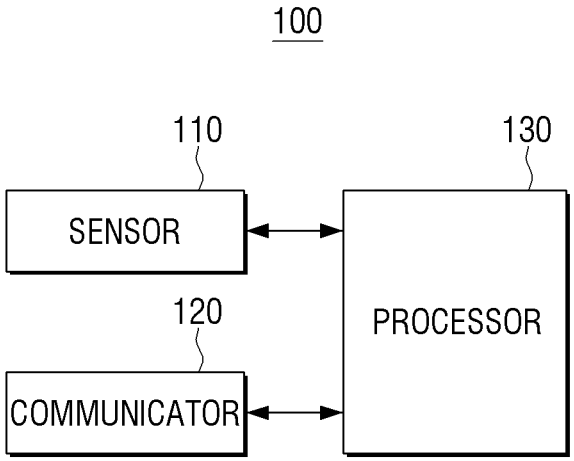
FIG. 2 is a block diagram of a schematic configuration of an electronic apparatus according to an exemplary embodiment.

FIG. 2 is a block diagram of a schematic configuration of the electronic apparatus 100, according to an exemplary embodiment. Referring to FIG. 2, the electronic apparatus 100 may include a sensor 110, the communicator 120, and the processor 130.

The sensor 110 may measure acceleration and angular speed of the electronic apparatus 100. For example, the sensor 110 may include an acceleration sensor and a gyro sensor. The sensor 110 may also be realized as a type constituted as one chip into which the acceleration sensor and the gyro sensor are integrated. Since the sensor 110 measures the acceleration and the angular speed of the electronic apparatus 100 attached to the door, the electronic apparatus 100 may sense a position change of the door, a shock applied onto the door, and the like.

The communicator 120 may transmit the determine states of the door to the external apparatus 200. For example, the external apparatus 200 may be realized as a cloud server or the like. Also, the communicator 120 may receive a state request signal from the external apparatus 200.

The processor 130 may determine the states of the door, onto which the electronic apparatus 100 is attached, by using the acceleration and angular speed measured by the sensor 110. The processor 130 may be realized as an additional chip or the MCU embedded in the communicator 120 may perform an operation of the processor 130.

In detail, the processor 130 may sense an arrangement or arrangement form between a doorframe to which the door is fixed and the door, by using the acceleration and the angular speed measured by the sensor 110. Also, the processor 130 may determine whether the door is opened and closed, according to the sensed arrangement form.

For example, if the door is a door that is pivotable based on an axis of a doorframe, the processor 130 may determine the arrangement form based on the measured angular speed. The processor 130 may also compensate for the angular speed by using the measured acceleration. Since an angle is acquired according to a method of integrating the angular speed with respect to time, errors gradually increase if the angular speed is not compensated for. Therefore, the processor 130 may compensate for an error value of the angle by using an acceleration value.

As another example, if the door is a door that is movable back and forth in a straight line direction based on the doorframe, the processor 130 may determine the arrangement form based on the measured acceleration. Also, the processor 130 may determine a direction toward which a sliding door moves, by using the gyro sensor.

As another example, if the door is a window, the processor 130 may determine states such as vibrations and the like occurring due to an environment such as a knock, wind, or the like, by using a value measured by the acceleration sensor.

If it is determined that the door is in a closed state, the processor 130 may determine whether a state of the door is changed, by using the measured acceleration. For example, if an angular speed change is sensed in the sensor 110 after the door is determined as being in the closed state, the processor 130 may determine that the door is changed into an opened state.

As another example, if there is no angular speed change after the door is determined as being in the closed state but an angular speed change is sensed by the sensor 110, the processor 130 may determine a detailed state of the door according to an angular speed change pattern. The processor 130 may determine the detailed state of the door by using at least one selected from an intensity, a cycle, the number of acceleration changes.

If the detailed state of the door is determined as a knock or an external intrusion state, the processor 130 may control the communicator 120 to notify the external apparatus 200 of a state of the door. If the external apparatus 200 is realized as a wearable device, a mobile device, or the like carried by the user, the processor 130 may notify the user that a particular state occurs.

Also, the processor 130 may control the communicator 120 to transmit the state of the door and a control command that enables the external apparatus 200 to perform an operation corresponding to the state of the door. For example, if the state of the door is determined as the external intrusion state, the processor 130 may notify the external apparatus 200 of the external intrusion state. Simultaneously with this, the processor 130 may control the communicator 120 to transmit a control command that enables the external apparatus 200 to automatically transmit a message for requesting a mobilization to a police or a security company.

In addition, if the determined state of the door is changed or a signal for requesting state information is received from the external apparatus 200, the processor 130 may control the communicator 120 to transmit a current state of the door to the external apparatus 200.

According to the electronic apparatus 100 according to various exemplary embodiments as described above, various types of scenarios may be sensed with respect to various types of doors.

Figure 3:
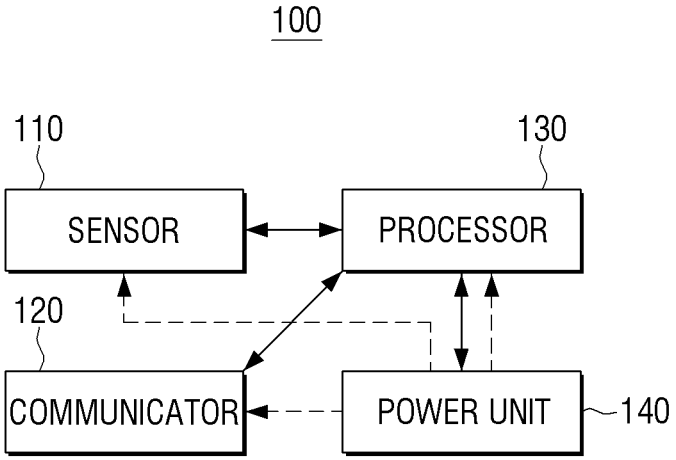
FIG. 3 is a block diagram of a detailed configuration of an electronic apparatus according to an exemplary embodiment.

FIG. 3 is a block diagram of a detailed configuration of the electronic apparatus 100 according to an exemplary embodiment. Referring to FIG. 3, the electronic apparatus 100 may include the sensor 110, the communicator 120, the processor 130, and a power unit 140. However, the electronic apparatus 100 according to the exemplary embodiment is not limited to an inclusion of all of the above-described elements. Also, the electronic apparatus 100 may additionally include elements that are not shown in the exemplary embodiment of FIG. 3. For example, the electronic apparatus 100 may further include a storage unit (not shown) capable of storing acceleration and angular speed values sensed by the sensor 110.

The sensor 110 may measure acceleration and angular speed in response to a type of a door to which the electronic apparatus 100 is attached. An existing door sensor includes two parts and thus mainly uses a magnet method of fixing one part to the door and the other part to a doorframe. However, the electronic apparatus 100 according to the exemplary embodiment may determine a state of the door through the sensor 110 realized as one part and thus may be simply installed.

The sensor 110 may include an acceleration sensor for measuring acceleration and a gyro sensor for measuring an angular speed. The sensor 110 may embody the acceleration sensor and the gyro sensor as one chip. The electronic apparatus 100 may sense a start position and a current position of a motion and measure position changes by using six axes of the acceleration sensor and the gyro sensor.

The acceleration sensor may sense a gravity direction. Also, the acceleration sensor may sense a gradient in an immovable state. The acceleration sensor senses changes in a speed with respect to a unit time. The acceleration sensor may be realized as three axes. If the acceleration sensor is realized as a triaxial acceleration sensor, the acceleration sensor includes X, Y, and Z acceleration sensors that are disposed in different directions to be orthogonal to one another.

The acceleration sensor respectively converts output values of the X, Y, and Z acceleration sensors into digital values and provides the digital values for a preprocessor. Here, the preprocessor may include a chopping circuit, an amplifier circuit, a filter, an analog-to-digital converter (ADC), and the like. Therefore, the preprocessor chops, amplifies, and filters an electrical signal output from the triaxial acceleration sensor, and converts the electrical signal into a digital voltage value.

The gyro sensor is an element that senses angular speed by sensing changes in a preset direction of the electronic apparatus 100 for a unit time. The gyro sensor may be a gyroscope having three axes. The gyro sensor may analyze an angle through a definite integral value of a sensed angular speed. However, if merely the gyro sensor is used, an accurate angle may be determined due to an accumulation of errors occurring in integral calculations.

The electronic apparatus 100 according to the exemplary embodiment may compensate for angular speed by using the measured acceleration. For example, the processor 130 may compensate for the angular speed by using a complementary filter or a Kalman filter. In other words, since the processor 130 includes the acceleration sensor and the gyro sensor, the sensor 110 may measure an accurate angle of the door.

According to another exemplary embodiment, if the door is determined as a closed state and then maintains the closed state until a preset time elapses, the sensor 110 may delete an accumulative error, which may occur, by re-calibrating or resetting the gyro sensor.

The sensor 110 may additionally include a geomagnetic sensor besides the acceleration sensor and the gyro sensor. The geomagnetic sensor is a sensor capable of detecting azimuth by detecting a flow of a magnetic field. The geomagnetic sensor may detect azimuth coordinates of the electronic apparatus 100 and detect a direction in which the electronic apparatus 100, based on the azimuth coordinates.

The geomagnetic sensor detects geomagnetism according to a method of measuring a voltage value induced by the geomagnetism by using a flux-gate or the like. The geomagnetic sensor may be realized as two axes or three axes. In this case, since a geomagnetic output value calculated by each axial geomagnetic sensor depends on a surrounding magnetic field size, the geomagnetic sensor normally performs normalization of mapping the geomagnetic output value in a preset range (e.g., within a range between −1 and 1). The normalization is performed by using a normalization factor such as a scale value or an offset value. In order to calculate the normalization factor, output values of the geomagnetic sensor may be calculated with rotating the geomagnetic sensor several times, and then a maximum value and a minimum value of the output values may be detected. A value normalized by the normalization factor is used for an azimuth correction job.

The communicator 120 may perform transmission and reception with the external apparatus 200. In detail, the communicator 120 may transmit the state of the door determined by the processor 130 to the external apparatus 200. The communicator 120 may also receive a state request command from the external apparatus 200.

For example, the communicator 120 may be realized as a module performing a Zigbee or Z-Wave communication. Zigbee and Z-Wave are short-range wireless communication methods for remote monitoring and controlling. Zigbee has a higher data speed and a narrower operation range than Z-wave. The communicator 120 may communicate with the external apparatus 200 by using a Zigbee or Z-Wave method according to a distance from the external apparatus 200 and the like.

Zigbee is a wireless standard complying with a Personal Area Network (PAN) wireless standard of Institute of Electrical and Electronics Engineers (IEEE) 802.15.4. Zigbee mainly operates in a band of 2.4 GHz and uses an Offset Quadrature Phase-Shift Keying (OQPSK) modulation. Also, Zigbee has a data speed of about 250 kbit/s and an operation range of about 10 m.

Z-Wave operates in a band of 908.42 MHz and uses a Gaussian Frequency-Shift Keying (GFSK) modulation. Also, Z-Wave has a data speed between about 9.6 kbit/s and about 40 kbit/s and an operation range of about 30 m.

Also, the communicator 120 may communicate with the external apparatus 200 by using various types of wireless communication methods such as WiFi, WiFi Direct, Bluetooth, Bluetooth Low Energy (BLE), and the like.

The power unit 140 may supply other elements of the electronic apparatus 100 with electric power under control of the processor 130.

If acceleration and angular speed changes measured for a preset time or more are in a preset range, the processor 130 may control the power unit 140 to supply electric power to merely the minimum number of elements maintaining an operation of the electronic apparatus 100. In other words, the processor 130 may change an operation mode of the electronic apparatus 100 into a standby mode. For example, in the standby mode, the processor 130 may control the power unit 140 to stop supplying power to the communicator 120.

If an acceleration change higher than or equal to a preset value is sensed after the operation mode is changed into the standby mode, the processor 130 may control the power unit 140 to supply power to all elements of the electronic apparatus 100. In other words, the processor 130 may change the operation mode of the electronic apparatus 100 from the standby mode into an operating mode.

Figure 4:
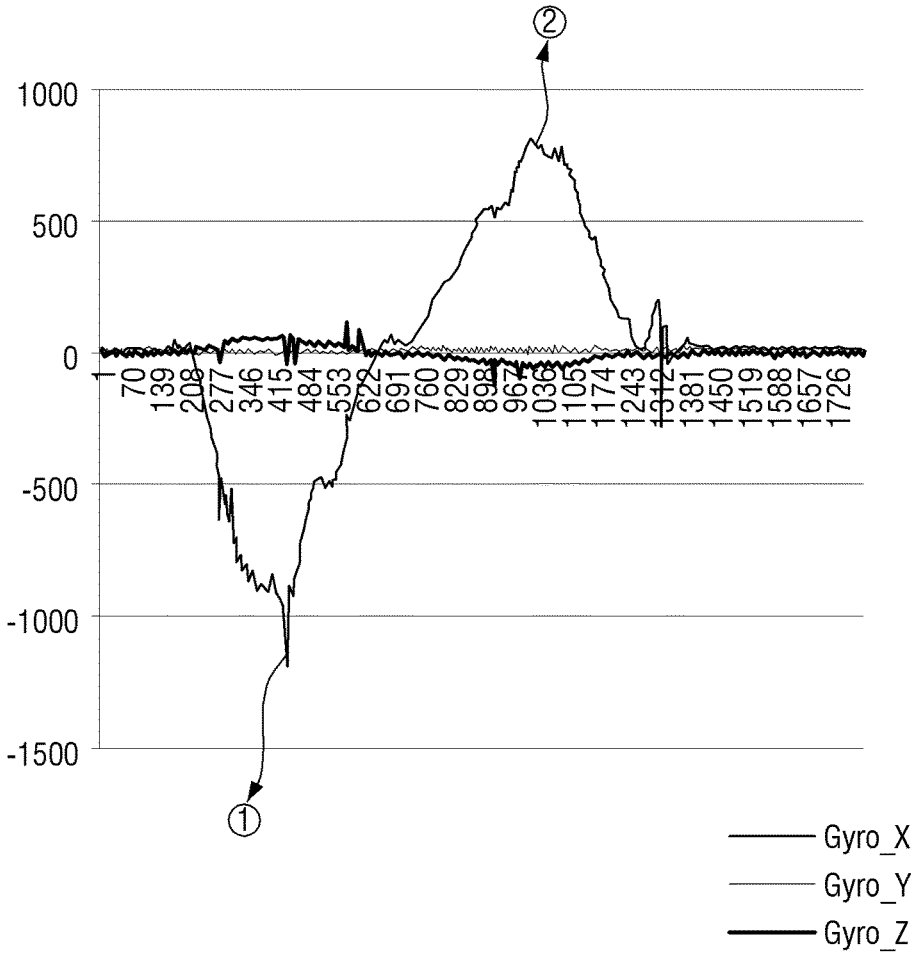
FIG. 4 is a graph illustrating data collected by a gyro sensor of an electronic apparatus according to an exemplary embodiment.

FIG. 4 is a graph illustrating data collected by a gyro sensor of the electronic apparatus 100, according to an exemplary embodiment. In the exemplary embodiment of FIG. 4, the electronic apparatus 100 is attached onto a door that is opened and closed according to X direction pivoting.

For example, if the door pivots in a closed state, the sensor 110 may sense an angular speed change as at a peak marked with number ①. The processor 130 may determine that an arrangement or arrangement form between the door and a doorframe is changed, by using angular speed value sensed by the sensor 110. In other words, the processor 130 may determine that the door is in an opened state when the peak marked with the number ① is generated.

On the contrary, if the door pivots in an opposite direction, the sensor 110 may sense angular speed change as at a peak marked with number ②. The processor 130 may determine that the door pivots in the opposite direction. In other words, the processor 130 may determine that the door is in a closed state when the peak marked with the number ② is generated.

Figure 5:
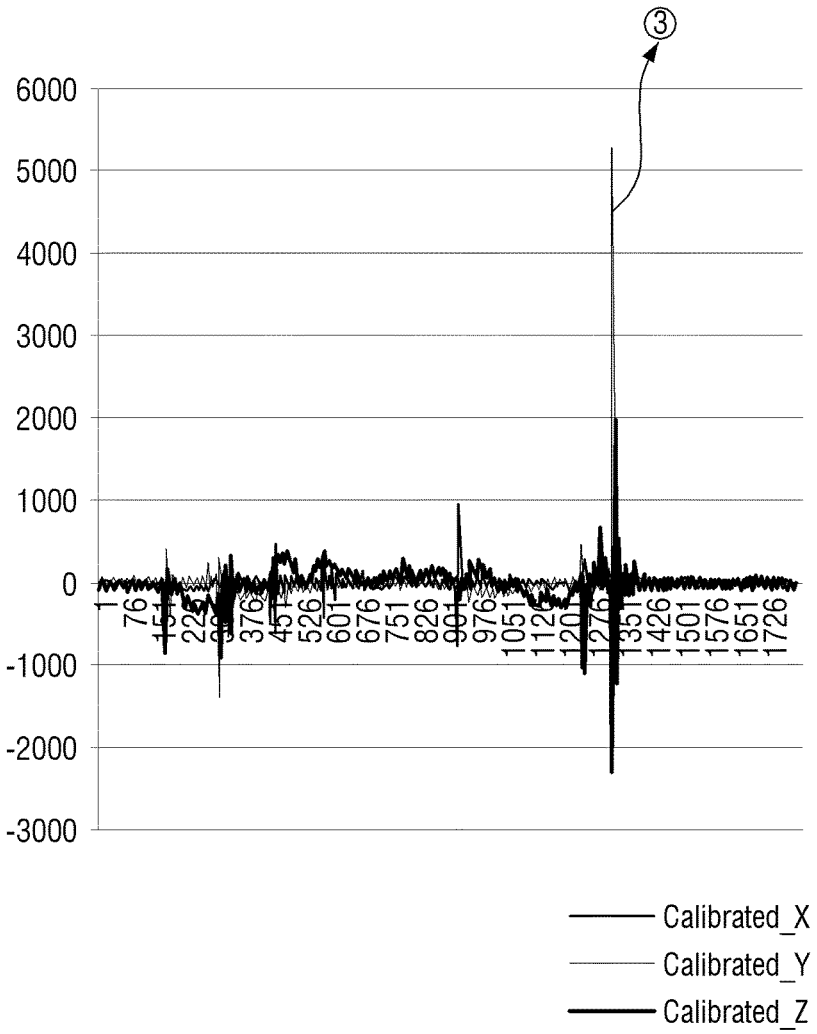
FIG. 5 is a graph illustrating data collected by an acceleration sensor of an electronic apparatus according to an exemplary embodiment.

FIG. 5 is a graph illustrating data collected by an acceleration sensor of the electronic apparatus 100, according to an exemplary embodiment. In the exemplary embodiment of FIG. 5, the electronic apparatus 100 is attached onto a door where an acceleration change occurs in a Y direction. Also, in the exemplary embodiment of FIG. 5, the door may be in a closed state.

If the door is in the closed state, and an acceleration change is measured as at a peak marked with number ③ of FIG. 5, the processor 130 may determine a detailed state of the door according to a measured acceleration change pattern.

According to an exemplary embodiment, the processor 130 may determine one of a knock state, a vibration state caused by an environment such as wind and the like, and an external intrusion attempt state according to the measured acceleration change pattern. The processor 130 may determine states based on an intensity, a cycle, and the number of acceleration changes.

For example, when the door is in a vibration state caused by an environment such as wind or the like, an intensity of an acceleration change sensed by the sensor 110 is lowest. Therefore, if an acceleration change is sensed as being lower than or equal to a preset intensity, the processor 130 may determine a state of the door as the vibration state caused by the environment.

As another example, if periodic acceleration changes between two times and three times are sensed as intermediate level intensities, the processor 130 may determine the state of the door as a knock state.

As another example, if the sensor 110 senses an acceleration change higher than or equal to a preset intensity or senses a periodic acceleration change for a preset time or more, the processor 130 may determine the state of the door as an external intrusion state.

The intensity, the cycle, and the number of the acceleration changes that are determination criterions of the processor 130 may be differently set according to specifications of a door onto which the electronic apparatus 100 is installed.

According to an exemplary embodiment, if acceleration and angular speed changes measured for a preset time or more are in a preset range, the processor 130 may change an operation mode of the electronic apparatus 100 into a standby mode. In detail, if there is the small number of changes in data measured by the sensor 110 for a preset time or more, the processor 130 may change a calculation block of the communicator 120 or the processor into a standby mode.

Also, if the sensor 110 senses acceleration or angular speed change higher than or equal to a preset value, the processor 130 may change the operation mode of the electronic apparatus 100 from the standby mode into an operating mode. In detail, when a change in data measured by the sensor 110 is higher than or equal to a preset value, the processor 130 may change the calculation block of the communicator 120 or the processor 130, which is changed into the standby mode, into the operating mode.

Figure 6:
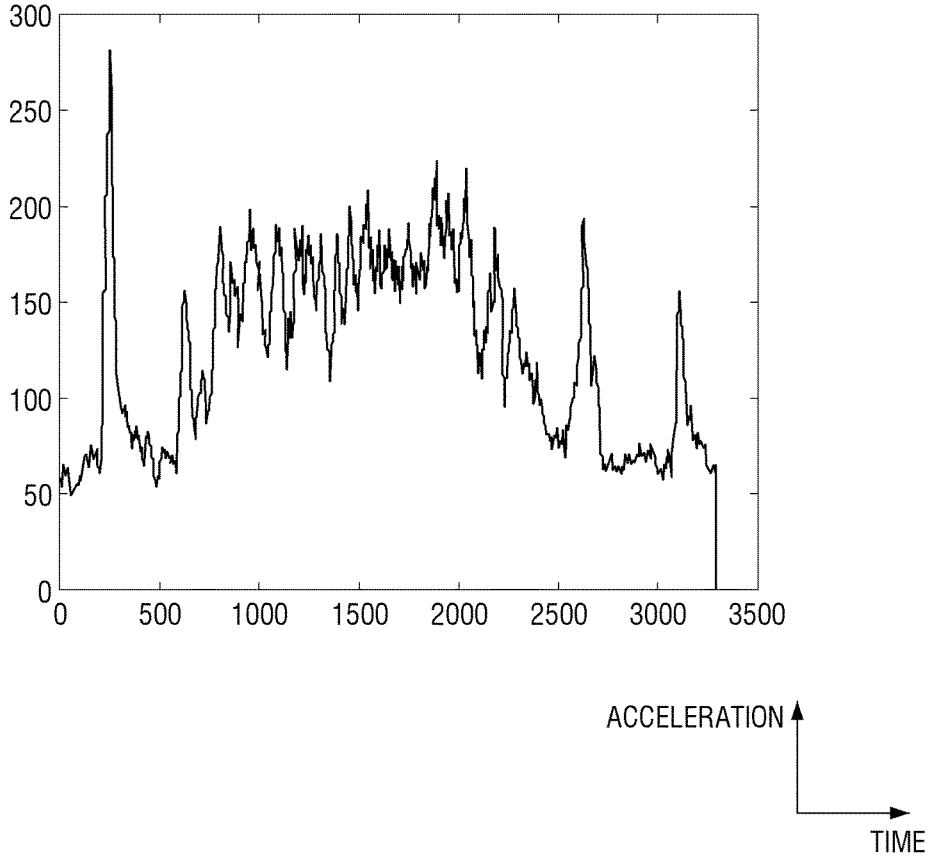
FIG. 6 is a graph illustrating a result of sensing vibrations in an electronic apparatus according to an exemplary embodiment.

FIG. 6 is a graph illustrating a result of sensing external vibrations in the electronic apparatus 100, according to an exemplary embodiment. FIG. 6 illustrates a test result of sensing vibrations occurring in an air cleaner that rarely vibrates.

On a vertical axis of FIG. 6, an acceleration (a gravity acceleration) of 1G as an acceleration value is written in unit of 8,192. As shown in FIG. 6, the sensor 110 according to an exemplary embodiment may measure an acceleration change between about 1/20 and 1/30 of the gravity acceleration. The processor 130 may set a preset value for changing a standby mode into an operating mode from a very low acceleration value.

Also, the processor 130 takes merely a time between 5 μs and 110 μs to change an operation mode of the electronic apparatus 100 as shown in Table 1 below. Therefore, the change into the standby mode does not affect a performance of a sensing operation of the processor 130.

TABLE 1

| Parameter | Test Condition | Min | Typ | Max | Unit |
|---|---|---|---|---|---|
| System wake time from deep sleep | From wake up event to first ARM ® Cortex ™-M3 instruction running from 6 MHz internal RC clock includes supply ramp time and oscillator startup time | — | 110 | — | μs |
| Shutdown time going into deep sleep | From last ARM ® Cortex ™-M3 instruction to deep sleep mode | — | 5 | — | μs |

As shown in Table 1, a deep sleep mode corresponds to a standby mode, and a wake up event corresponds to a change into an operating mode. According to the test result shown in FIG. 1, the electronic apparatus 100 takes a time of 5 μs to change into the standby mode and takes a time of 110 μs to change into the operating mode.

The electronic apparatus 100 according to an exemplary embodiment may be changed into the standby mode so as to reduce an amount of consumed electricity power. Table 2 below shows an amount of consumed current if the electronic apparatus 100 is changed into the standby mode. An amount of current consumed in the standby mode may be merely several μA.

TABLE 2

| Parameter | Test Condition | Min | Typ | Max | Unit |
|---|---|---|---|---|---|
| Regulator input voltage (VDD_PADS) | | 2.1 | — | 3.6 | V |
| Power supply range (VDD_MEM) | Regulator output or external input | 1.7 | 1.8 | 1.9 | V |
| Power supply range (VDD_CORE) | Regulator output | 1.18 | 1.25 | 1.32 | V |
| | Deep Sleep Current | | | | |
| Quiescent current, internal oscillator disable, 4 kB RAM retained | −40°, VDD_PADS = 3.6 V | — | 0.9 | — | μA |
| | +25°, VDD_PADS = 3.6 V | — | 1.0 | — | μA |
| | +85°, VDD_PADS = 3.6 V | — | 2.2 | — | μA |
| Quiescent current, including internal RC oscillator, 4 kB RAM retained | −40°, VDD_PADS = 3.6 V | — | 1.2 | — | μA |
| | 25°, VDD_PADS = 3.6 V | — | 1.25 | — | μA |
| | 85°, VDD_PADS = 3.6 V | — | 2.5 | — | μA |
| Quiescent current, including 32.768 kHz oscillator, 4 kB RAM retained | −40°, VDD_PADS = 3.6 V | — | 1.3 | | μA |
| | 25°, VDD_PADS = 3.6 V | — | 1.6 | — | μA |
| | 85°, VDD_PADS = 3.6 V | — | 2.9 | — | μA |
| Quiescent current, including RC oscillator and 32.768 kHz oscillator, 4 kB RAM retained | −40°, VDD_PADS = 3.6 V | — | 1.6 | — | μA |
| | 25°, VDD_PADS = 3.6 V | — | 1.9 | — | μA |
| | 85°, VDD_PADS = 3.6 V | — | 3.2 | — | μA |
| Additional quiescent current per 4 kB block of RAM retained | −40°, VDD_PADS = 3.6 V | — | 0.007 | — | μA |
| | 25°, VDD_PADS = 3.6 V | — | 0.067 | | μA |
| | 85°, VDD_PADS = 3.6 V | — | 0.76 | — | μA |
| Additional quiescent current when retained RAM exceeds 32 kB | −40°, VDD_PADS = 3.6 V | — | 0.57 | — | μA |
| | 25°, VDD_PADS = 3.6 V | — | 0.67 | — | μA |
| | 85°, VDD_PADS = 3.6 V | — | 2.0 | — | μA |
| Simulated deep sleep (debug mode) current | with no debugger activity | — | 500 | — | μA |

If a camera and the like are attached to improve an existing sensor, a current is consumed on a level of 300 mA, and thus it is inappropriate to use a miniaturized coin battery (225 mAh capacity). However, the electronic apparatus 100 according to an exemplary embodiment may determine a state of a door by using data sensed by the sensor 110 and thus may operate even at a capacity of a miniaturized coin battery. Also, if the electronic apparatus 100 is changed into a standby mode, an amount of consumed current is further reduced.

According to this characteristic, the electronic apparatus 100 according to an exemplary embodiment may reduce an amount of consumed electricity power and may additionally reduce a space restriction and a size.

Figure 7:
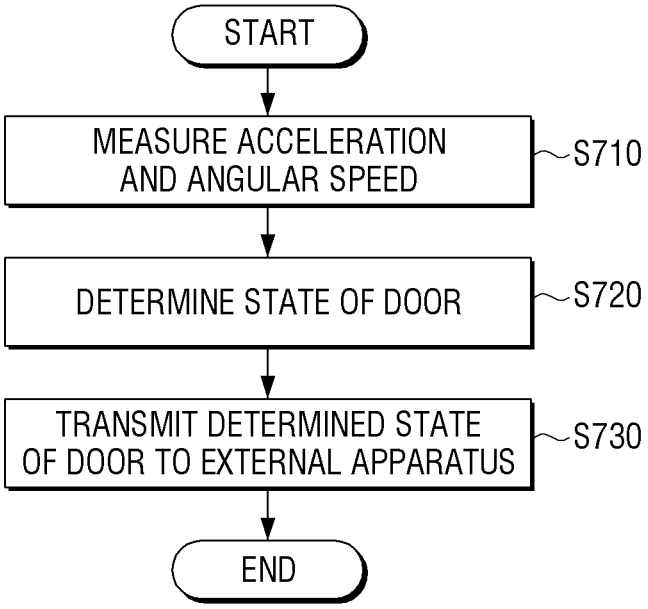
FIGS. 7 and 8 are flowcharts of methods of determining door states of an electronic apparatus according to various exemplary embodiments.

FIG. 7 is a flowchart of a method of determining a door state of the electronic apparatus 100, according to an exemplary embodiment.

Referring to FIG. 7, in operation S710, the electronic apparatus 100 may measure acceleration and angular speed. The electronic apparatus 100 may check acceleration and angular speed of a door onto which the electronic apparatus 100 is attached, by measuring acceleration and angular speed thereof. For this, the electronic apparatus 100 may include an acceleration sensor and a gyro sensor.

In operation S720, the electronic apparatus 100 may determine a state of the door by using the measured acceleration and angular speed. In detail, the electronic apparatus 100 may sense an arrangement form between the door and a doorframe to which the door is fixed, by using the measured acceleration and angular speed. This is because a position change of the electronic apparatus 100 is checked through acceleration and angular speed. Also, the electronic apparatus 100 may determine whether the door is opened or closed, according to the sensed arrangement form.

For example, if the door is a door that is pivotable based on an axis of the doorframe, the electronic apparatus 100 may sense the arrangement form based on the measured acceleration. The electronic apparatus 100 may determine a movement angle by performing a definite integral with respect to the measured angular speed. In this case, the electronic apparatus 100 may compensate for an angular speed value by using the measured acceleration. Since errors caused by the definite integral gradually increase, the electronic apparatus 100 may compensate for the angular speed value by using a Kalman filter or a complementary filter.

As another example, if the door is a sliding door that is movable back and forth in a straight line direction based on the doorframe, the electronic apparatus 100 may sense the arrangement form based on the measured acceleration. The electronic apparatus 100 may sense a movement distance by using an acceleration value. The electronic apparatus 100 may also sense in which direction the door slides, by using an angular speed value.

In operation S730, the electronic apparatus 100 may transmit the determined state of the door to the external apparatus 200. The electronic apparatus 100 may be connected to the external apparatus 200 to form an Internet of Things (IoT) environment.

Figure 8:
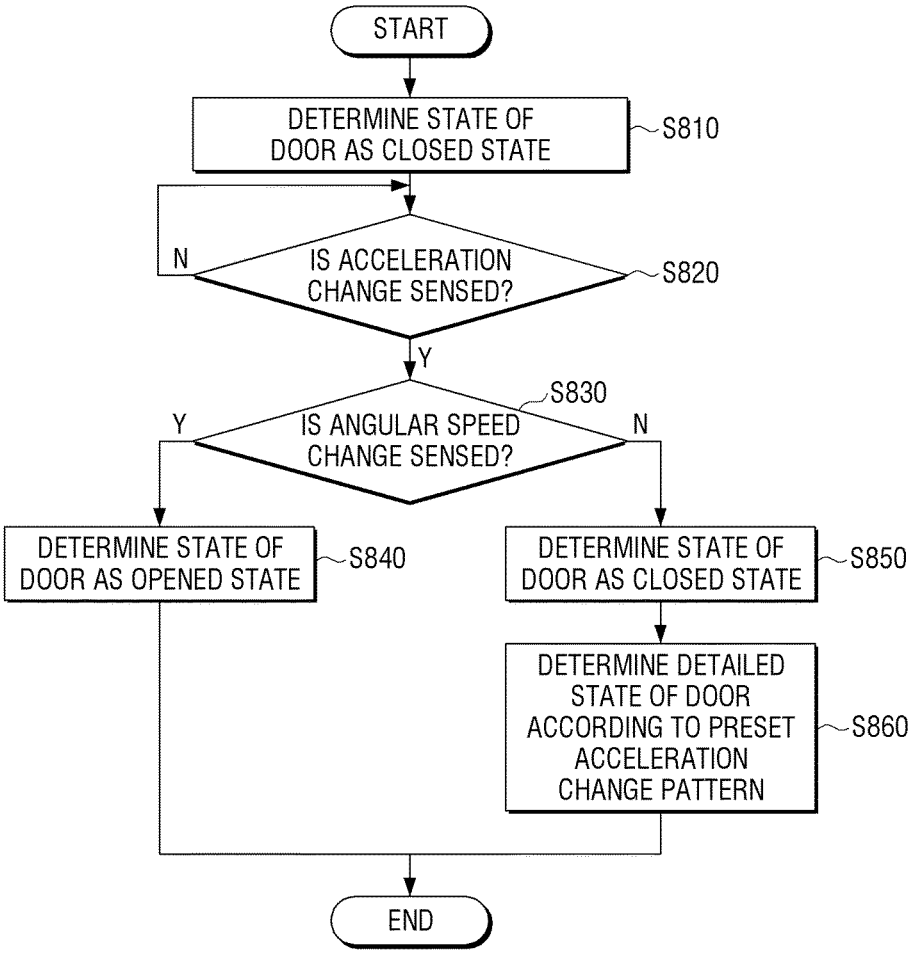

FIG. 8 is a flowchart of a method of determining a door state of the electronic apparatus 100, according to another exemplary embodiment. The exemplary embodiment of FIG. 8 is a flowchart for describing an operation performed after a state of a door is determined as a closed state.

In operation S810, the electronic apparatus 100 may determine the state of the door as the closed state. For example, the electronic apparatus 100 may determine that the state of the door is the closed state, based on an angle range sensed by the gyro sensor.

If an acceleration shock occurs when the door is in the closed state, the electronic apparatus 100 may sense an acceleration change. If the acceleration change is sensed in operation S820 (S820-Y), the electronic apparatus 100 may determine whether an angular speed change also occurs in operation S830.

If the angular speed change is sensed in operation S830 after sensing the acceleration change (S830-Y), the electronic apparatus 100 may determine that the door pivots. In other words, the electronic apparatus 100 may determine the state of the door as an opened state in operation S840.

If the acceleration change is sensed but there is no angular speed change in operation S830 (S830-N), the electronic apparatus 100 may determine that the state of the door is maintained as the closed state in operation S850. Also, the electronic apparatus 100 may determine a detailed state occurring in the closed state.

In detail, the electronic apparatus 100 may determine the detailed state of the door on which the electronic apparatus 100 is installed, according to a preset acceleration change pattern in operation S860. For example, the electronic apparatus 100 may determine the state of the door as one selected from a knock state, a vibration state caused by an environment such as wind and the like, and an external intrusion attempt state. The electronic apparatus 100 may respectively determine states of the door based on intensity, a cycle, and a number of acceleration changes.

If the state of the door is determined as a state where a notification message needs to be transmitted to a user as in the knock state or in the external intrusion attempt state, the electronic apparatus 100 may notify the external apparatus 200 of the state of the door.

The electronic apparatus 100 according to various exemplary embodiments as described above may be simply installed on a door so as to determine various states of a door such as opening and closing, vibrations, knocks, external intrusions, and the like.

Methods as described above may be embodied as a program command form that may be performed by various types of computer means and then may be recorded on a non-transitory computer readable medium. The computer readable medium may singly include or may combine a program command, a data file, a data structure, and the like. The program command recorded on the computer readable medium may particularly designed or constituted for the embodiments or may be well known to and used by software developers. Examples of the computer readable medium include magnetic media such as a hard disk, a floppy disk, and a magnetic tape, optical media such as a CD-ROM and a DVD, magneto-optical media such as an optical disk, and a hardware device that is particularly configured so as to store and perform a program command, such as an ROM, an RAM, a flash memory, and the like. Examples of the program command include a machine language code that is formed by a compiler and a high-level language code that may be executed by a computer by using an interpreter or the like. The hardware device may be configured to operate as one or more software modules so as to perform an operation of the embodiments, and an opposite case thereof is possible.

The foregoing exemplary embodiments and advantages are merely exemplary and are not to be construed as limiting. The present teaching can be readily applied to other types of apparatuses. Also, the description of the exemplary embodiments is intended to be illustrative, and not to limit the scope of the claims, and many alternatives, modifications, and variations will be apparent to those skilled in the art.

Although a few embodiments have been shown and described, it would be appreciated by those skilled in the art that changes may be made in these embodiments without departing from the principles and spirit thereof, the scope of which is defined in the claims and their equivalents.

What is claimed is:

1. An electronic apparatus attached on a door, the electronic apparatus comprising:

a sensor device configured to measure acceleration and angular speed of the electronic apparatus;

a processor configured to identify a type of the door, sense an arrangement between the door and a doorframe to which the door is fixed, by using at least one of the acceleration and the angular speed based on the type of the door, and identify a door state as to whether the door is one of opened and closed, according to the arrangement; and a communicator configured to transmit the state of the door to an external apparatus, wherein the processor senses the arrangement based on the angular speed if the type of the door is a pivotable door and senses the arrangement based on the acceleration if the type of the door is a sliding door.

2. The electronic apparatus of claim 1, wherein the pivotable door is pivotable based on an axis of the doorframe.

3. The electronic apparatus of claim 1, wherein the processor compensates for the angular speed using the acceleration and senses the arrangement based on a compensated angular speed.

4. The electronic apparatus of claim 1, wherein the sliding door is movable back and forth in a straight line direction based on the doorframe.

5. The electronic apparatus of claim 1, wherein the processor determines one of a knock and an external intrusion by using the acceleration in response to the state of the door being a closed state.

6. The electronic apparatus of claim 5, wherein in response to the state of the door being determined as the one of the knock and the external intrusion, the processor controls the communicator to notify the external apparatus of the state of the door.

7. The electronic apparatus of claim 1, wherein in response to one of the state of the door being changed and a state request being received from the external apparatus, the processor controls the communicator to transmit the state of the door to the external apparatus.

8. The electronic apparatus of claim 1, wherein in response to changes in the acceleration and the angular speed measured for a predetermined time or more, being within a predetermined range, the processor changes an operation mode of the electronic apparatus into a standby mode.

9. The electronic apparatus of claim 8, wherein in response to an acceleration change higher than or equal to a predetermined value, being sensed, the processor changes the operation mode of the electronic apparatus from the standby mode into the operation mode.

10. A method of determining a door state of an electronic apparatus attachable to a door, the method comprising:

measuring acceleration and angular speed of the electronic apparatus;

identifying a type of the door;

sensing an arrangement between a doorframe to which the door is fixed and the door, by using at least one of the acceleration and the angular speed based on the type of the door;

identifying the door state as to whether the door is one of opened and closed, according to the arrangement; and transmitting the state of the door to an external apparatus, wherein the sensing comprises sensing the arrangement based on the angular speed if the type of the door is a pivotable door and sensing the arrangement based on the acceleration if the type of the door is a sliding door.

11. The method of claim 10, wherein the pivotable door is a pivotable based on an axis of the doorframe.

12. The method of claim 10, wherein the sensing comprises compensating for the angular speed by using the acceleration and sensing the arrangement based on a compensated angular speed.

13. The method of claim 10, wherein the sliding door is movable back and forth in a straight line direction based on the doorframe.

14. The method of claim 10, further comprising:

in response to the state of the door being a closed state, determining one of a knock and an external intrusion by using the acceleration.

15. The method of claim 14, further comprising:

in response to the state of the door being the one of the knock and the external intrusion, notifying the external apparatus of the state of the door.

16. The method of claim 10, wherein the transmitting comprises, in response one of to the state of the door being changed and a state request being received from the external apparatus, transmitting the state of the door to the external apparatus.

17. The method of claim 10, further comprising:

in response to changes in the acceleration and the angular speed measured for a predetermined time or more, being within a predetermined range, changing an operation mode of the electronic apparatus into a standby mode.

18. The method of claim 17, further comprising:

in response to an acceleration change higher than or equal to a predetermined value, being sensed, changing the operation mode of the electronic apparatus from the standby mode into the operation mode.

19. A non-transitory computer readable recording medium storing a method of determining a door state of an electronic apparatus attachable to a door, the method comprising:

measuring acceleration and angular speed of the electronic apparatus;

identifying a type of the door;

sensing an arrangement between a doorframe to which the door is fixed and the door, by using at least one of the acceleration and the angular speed based on the type of the door;

identifying the door state as to whether the door one of is opened and closed, according to the arrangement; and transmitting the state of the door to an external apparatus, wherein the sensing comprises sensing the arrangement based on the angular speed if the type of the door is a pivotable door and sensing the arrangement based on the acceleration if the type of the door is a sliding door.

* * * * *